US005409403A

United States Patent [19]

Falossi et al.

[11] Patent Number: 5,409,403

[45] Date of Patent: Apr. 25, 1995

[54] 360 DEGREE CONNECTOR SYSTEM

[76] Inventors: Aldo Falossi, 22496 Caminito Grande, Laguna Hills, Calif. 92653; Paul Thomas, 1257 W. O'Farrell St., San Pedro, Calif. 90731

[21] Appl. No.: 140,545

[22] Filed: Oct. 25, 1993

[51] Int. Cl.[6] ..... H01R 13/625

[52] U.S. Cl. ..... 439/668; 439/736; 439/21; 439/25

[58] Field of Search ..... 439/13–23, 439/33, 34, 668, 669, 736, 24, 25, 26

[56] References Cited

U.S. PATENT DOCUMENTS

| | | | |
|---|---|---|---|
| 2,466,499 | 4/1949 | Sokolik | 439/21 |
| 2,749,526 | 6/1956 | Peterson | 439/668 |
| 3,193,636 | 7/1965 | Daniels | 439/20 |
| 3,278,885 | 10/1966 | Klinger | 439/668 |
| 3,665,509 | 5/1972 | Elkins | 439/668 |

*Primary Examiner*—David L. Pirlot
*Attorney, Agent, or Firm*—Thomas I. Rozsa; Tony D. Chen

[57] ABSTRACT

The present invention is a novel and unique 360° connector system which can be used in an in-line cable to cable application, but can also be utilized in various applications such as a power tool, an extension cord, etc. The uniqueness of the 360° connector system is the concave/convex longitudinal tubular surfaces and transverse circular surfaces of the male and female connectors for improved area contact, thereby creating continuity and allowing the connector system to turn around freely in a 360° rotation. The essential components of the present invention 360° connector system basically include a male connector and a female connector rotatably connected to each other. Both of the male and female connectors are generally made of an elastomer material, instead of the standard static material.

76 Claims, 6 Drawing Sheets

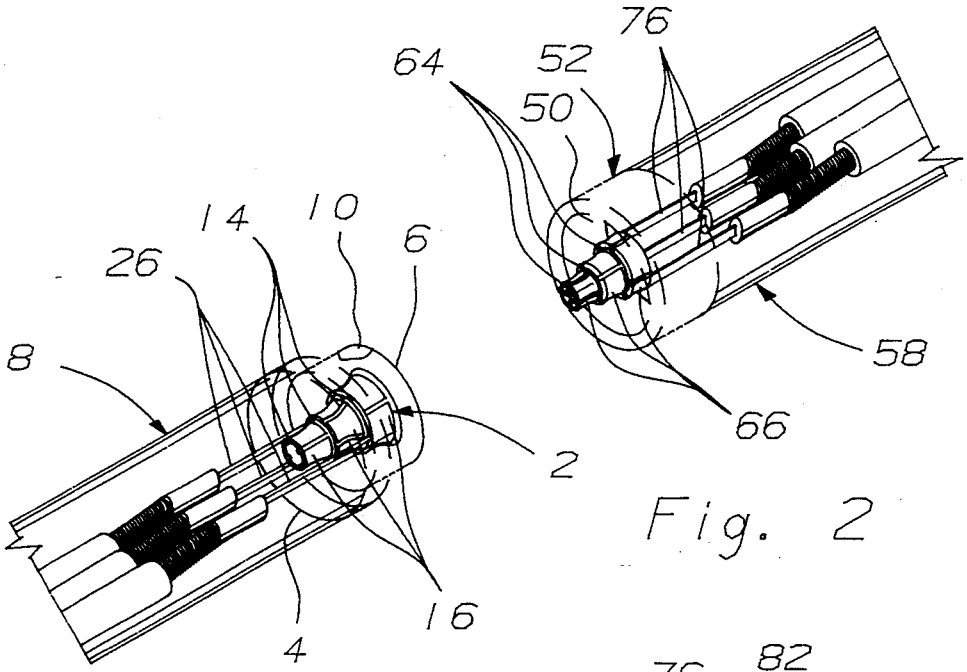
Fig. 2
Fig. 1
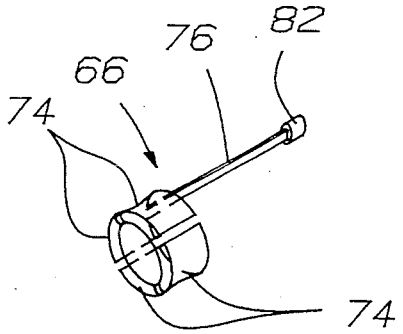
Fig. 4
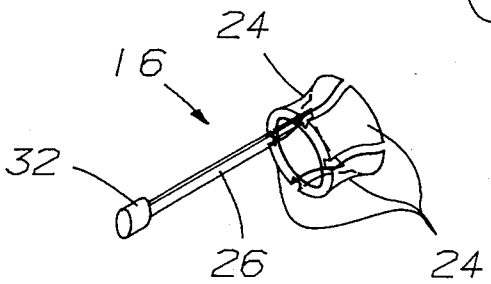
Fig. 3
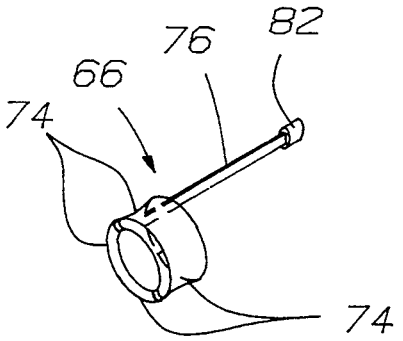
Fig. 4A
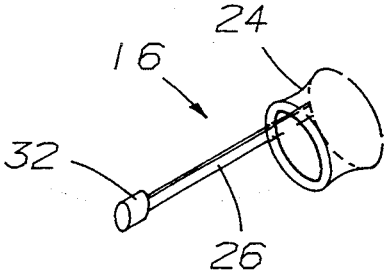
Fig. 3A

360 DEGREE CONNECTOR SYSTEM

BACKGROUND OF THE INVENTION 1. Field of The Invention

The present invention relates to the field of electrical connectors and systems. In particular, the present invention relates to the field of swivel systems which can rotate in a 360° rotation. 2. Description of The Prior Art Part of the problem which the present invention addresses is that prior art devices utilize rings and springs in their swivel devices such that the springs are forced into contact with the rings in the device. The springs are inside a bayonetted type configuration. One of the disadvantages of the prior art swivel devices is that they are highly mechanical mechanisms and very expensive to produce, and therefore not cost effective. Another disadvantage is that prior art swivel devices provide only one contact surface and therefore failure often occurs during operation.

In other prior art applications, they utilize conventional male and female connectors for making conductivity between the chassis and the cable. The disadvantage in this application is that the connector connected to the cable cannot rotate freely and if the connector is inadvertently rotated, the pins can become loosened and a short circuit often occurs. The connectors are stationary in one direction, which further limits the application. In another prior art application, they utilize radio jacks for a printed circuit board (PCB) mount. This application has the same disadvantage as mentioned above, where the radio jack is connected to the cable in which it cannot rotate freely. In these applications, the blades, the pins, and the prior art swivel devices are more resistant to being pull-out from each other and failure often occurs during operation.

The main purpose for utilizing swivel contact mechanisms is to provide a device for turning around freely in a transverse plane and to prevent failure. Therefore, it is highly desirable to have a very efficient and also very effective design and construction of a 360° connector system which can be incorporated in a communications connector and can also be used in various applications such as a power tool, appliances, computers, extension cords, etc.

SUMMARY OF THE INVENTION

The present invention is a novel and unique 360° connector system which includes a male connector and a female connector. The novelty of the present invention is that the 360° connector system can rotate in a transverse plane and the concave/convex longitudinal tubular surfaces and transverse circular surfaces of the male and female connectors of the connector system provide a latching method for retaining both the male and female connectors together. The present invention also provides strain relief for the cable wires and does not put strain on the cable wires. The strain is spread over the extended length of the cable.

It has been discovered, according to the present invention, that it is highly desirable to employ a 360° connector system that is able to turn around freely in a transverse plane, and which will also relieve any strain that otherwise might be transmitted to the joint between the cable wires.

It has also been discovered, according to the present invention, that by utilizing a male connector and a female connector in the connector system, it will provide an easier way of connecting the two separate connectors together.

It has further been discovered, according to the present invention, that by utilizing concave/convex surfaces in the male and female connectors of the connector system, it will provide a latching method for retaining both the male and female connectors of the connector system together.

It has additionally been discovered, according to the present invention, that by utilizing stamped metal ring plates integrally molded to the elastomer material in the male and female connectors of the connector system, the contact on both the longitudinal tubular surfaces and the transverse circular surfaces will be greatly improved because of the expansive forces created by the elastomer material.

It is therefore an object of the present invention to provide a 360° connector system which can be utilized in many applications.

It is also an object of the present invention to provide a male connector and a female connector in a 360° connector system, so that connecting the two separate connectors together will be less complicated.

It is a further object of the present invention to provide concave/convex surfaces in the male and female connectors of a 360° connector system, so that a latching method is provided for retaining both the male and female connectors of the 360° connector system together.

It is an additional object of the present invention to provide stamped metal ring plates integrally molded to the elastomer material on the male and female connectors of a 360° connector system, so that the contact on both the longitudinal tubular surfaces and the transverse circular surfaces will be greatly improved because of the expansive forces created by the elastomer material.

It is a further object of the present invention to provide a 360° connector system which has a very efficient and very effective design and construction.

The construction of the present invention 360° connector system consists of two constituent parts. The first part is a male connector which is integrally molded to a communication connector or a cable. The second part is a female connector which is integrally molded to a communication connector or a cable. The male connector is inserted into the female connector such that the male connector has a constant force being expanded outwardly and the female connector has a constant force being expanded inwardly. The constant force is created by a fixed pivot point and sustained by an elastomeric subsurface beneath the contacts. The elastomeric material also serves as an insulation and a spring.

Described generally, the present invention is a 360° connector system such that the male connector is detachably attachable to the female connector and can be turned freely in a transverse plane. The essential components of the preferred embodiment of the present invention 360° connector system basically include a male connector and a female connector rotatably connected to each other. Both of the male and female connectors are generally made of an elastomer material, instead of the standard static material used in the prior art swivel devices.

In general, the uniqueness of the present invention is the elastomer material utilized in the male and female connector of the 360° connector system. While most of the prior art uses contacts that perform contacts as springs, the present invention depends solely on the principle of utilizing expansive forces by creating a compression against the elastomer material versus the static structure. In addition, the concave/convex longitudinal tubular surfaces and the transverse circular surfaces on the male and female connectors are shaped for improved area contact and lubricous materials.

The present invention is not limited to the in-line cable to cable application. The present invention can also be utilized in various applications such as a power tool, an extension cord, etc.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG, 1 is a perspective view of a female connector of a 360° connector system integrally molded onto a cable.

FIG. 2 is a perspective view of a male connector of the 360° connector system integrally molded onto a cable.

FIG: 3 is a perspective view of one of the stamped ring plates of the female connector, in which the stamped ring plate is split into four segments.

FIG. 3*a* is a perspective view of one of the stamped ring plates of the female connector, in which the stamped ring plate is not split.

FIG. 4 is a perspective view of one of the stamped ring plates of the male connector, in which the stamped ring plated is split into at least two segments.

FIG. 4*a* is a perspective view of one of the stamped ring plates of the male connector, in which the stamped ring plated is split into at least two segments.

Figure 5:
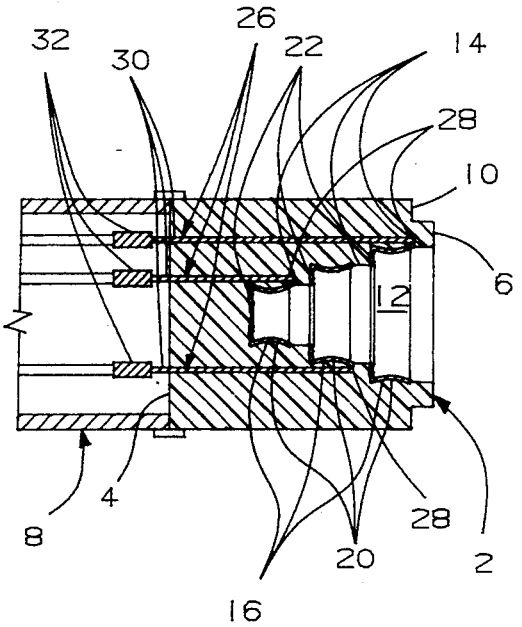

FIG. 5 is a cross-sectional view of the female connector of the connector system.

Figure 6:
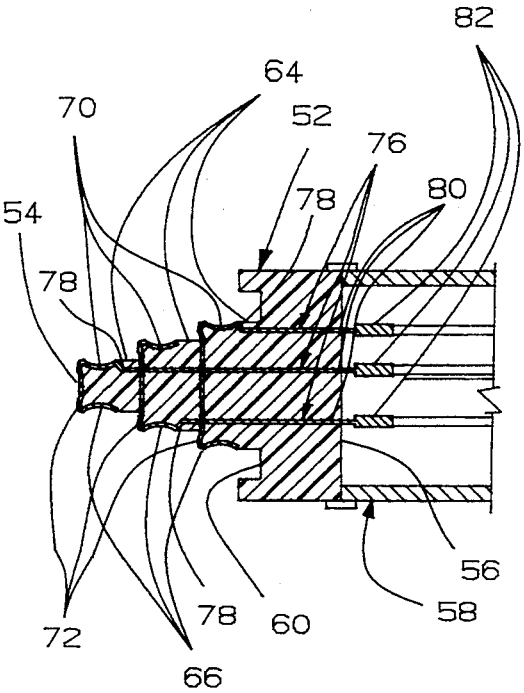

FIG. 6 is a cross-sectional view of the male connector of the connector system.

Figure 7:
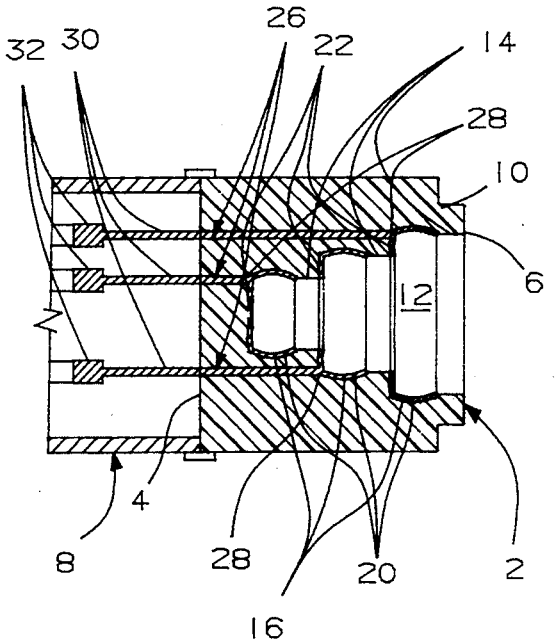

FIG. 7 is a cross-sectional view of the female connector of the connector system showing the concave surfaces.

Figure 8:
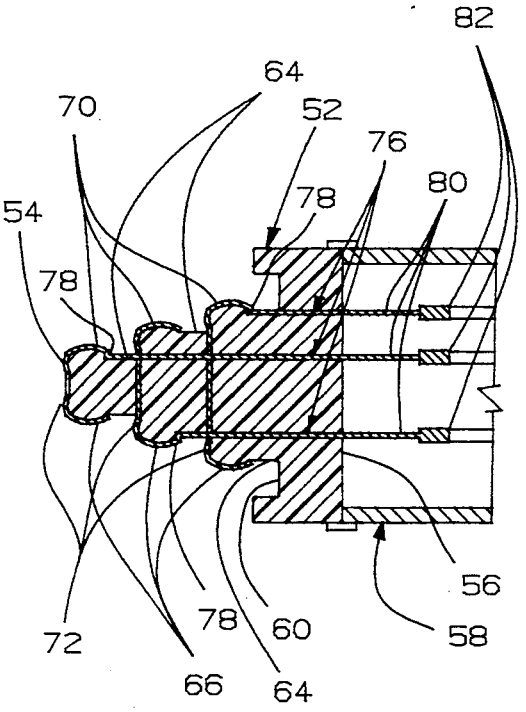

FIG. 8 is a cross-sectional view of the male connector of the connector system showing the convex surfaces.

Figure 9:
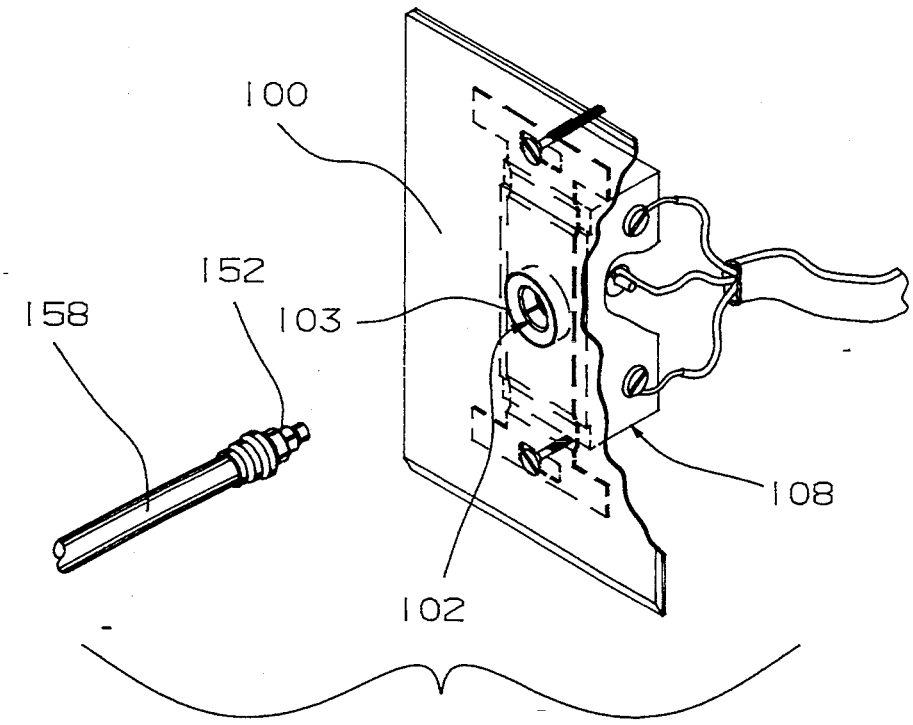

FIG. 9 is a partially cut-out perspective view of a wall outlet application, in which the female connector of the 360° connector system is fixed to the wall outlet and the male connector is connected to a cable.

Figure 10:
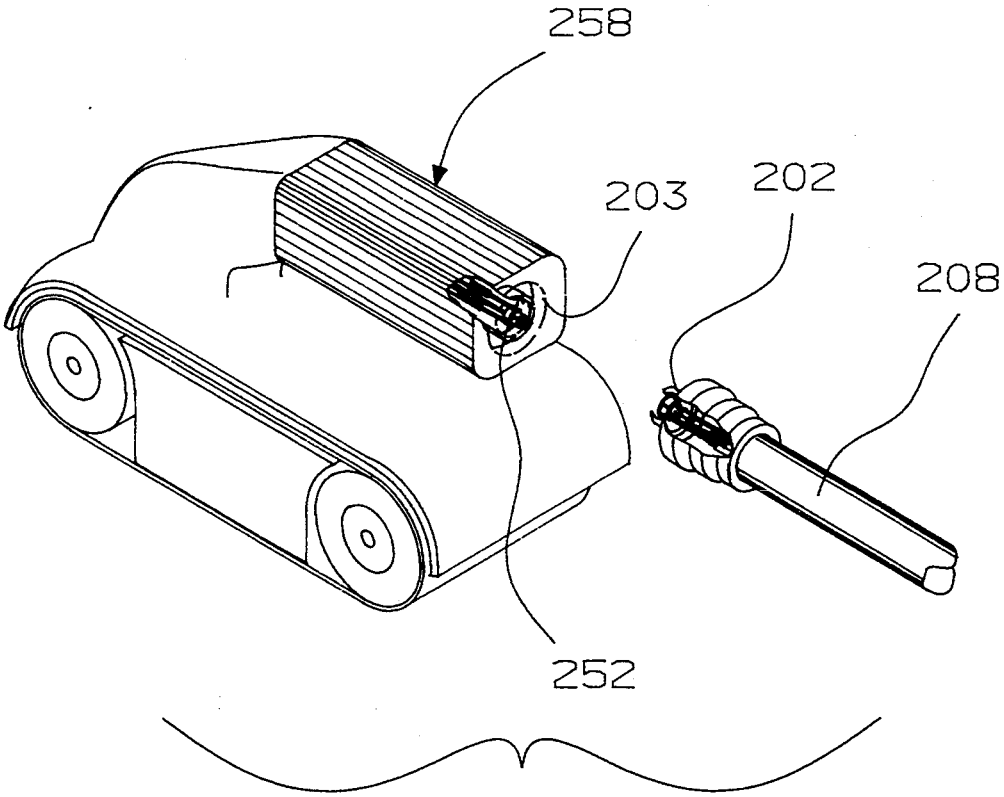

FIG. 10 is a partially cut-out perspective view of a sander application, in which the male connector of the 360° connector system is fixed to the sander unit and the female connector is connected to a cable.

Figure 11:
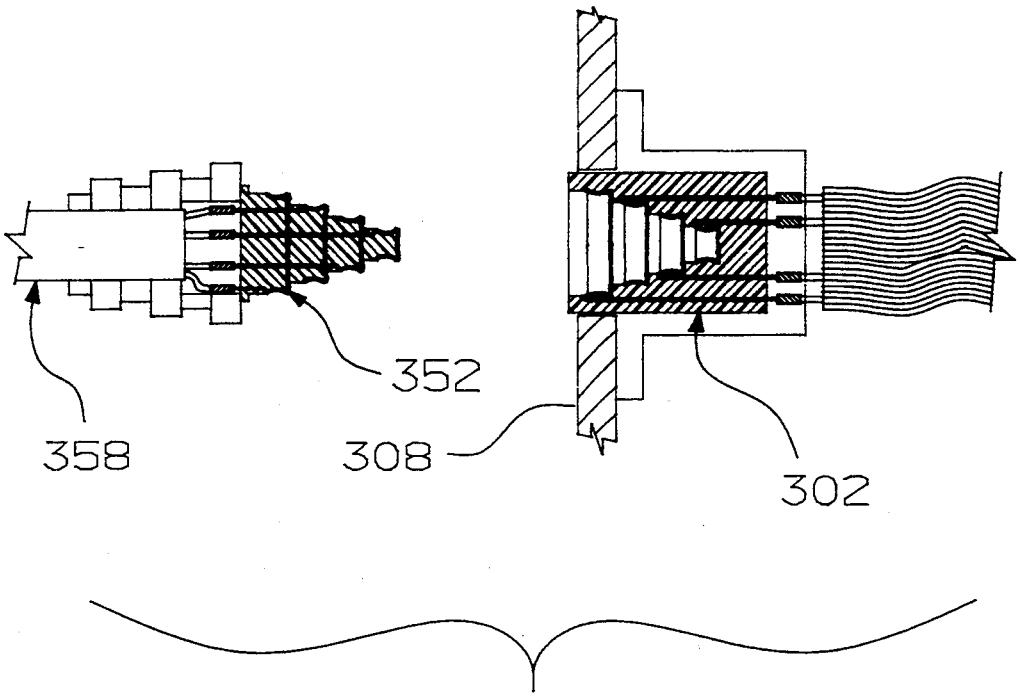

FIG. 11 is a cross-sectional view of a cable to chassis application, in which the male connector of the 360° connector system is connected to the cable and the female connector is stationary on the chassis.

Figure 12:
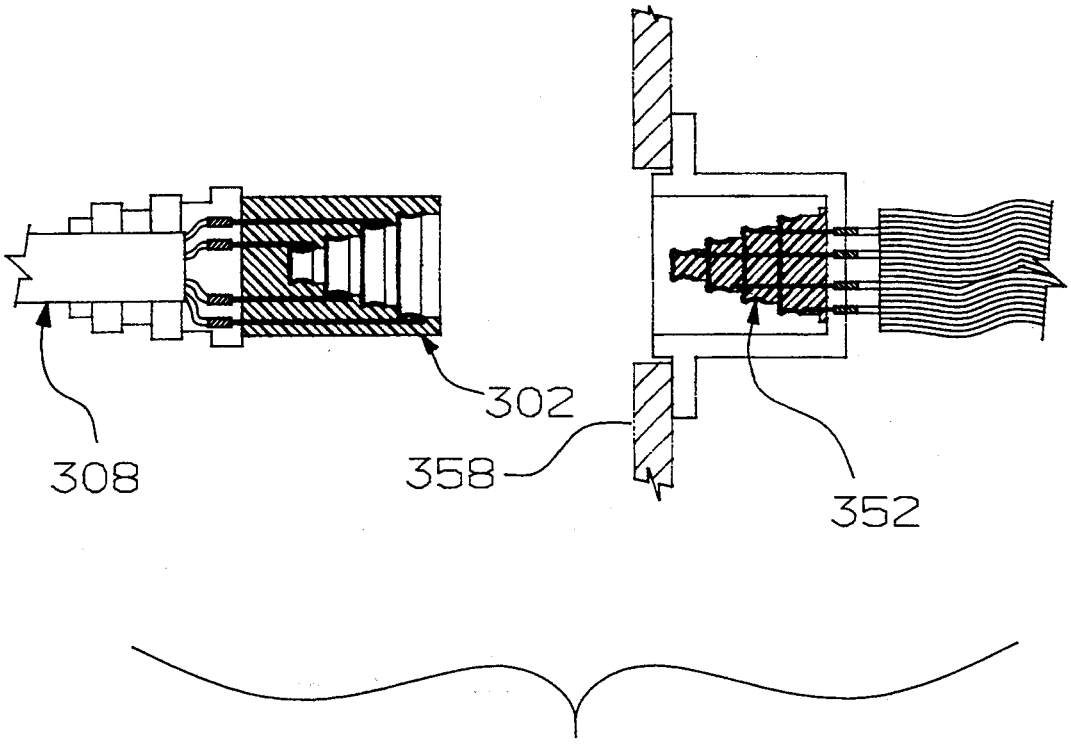

FIG. 12 is a cross-sectional view of the cable to chassis application, in which the female connector of the 360° connector system is connected to the cable and the male connector is stationary on the chassis.

Figure 13:
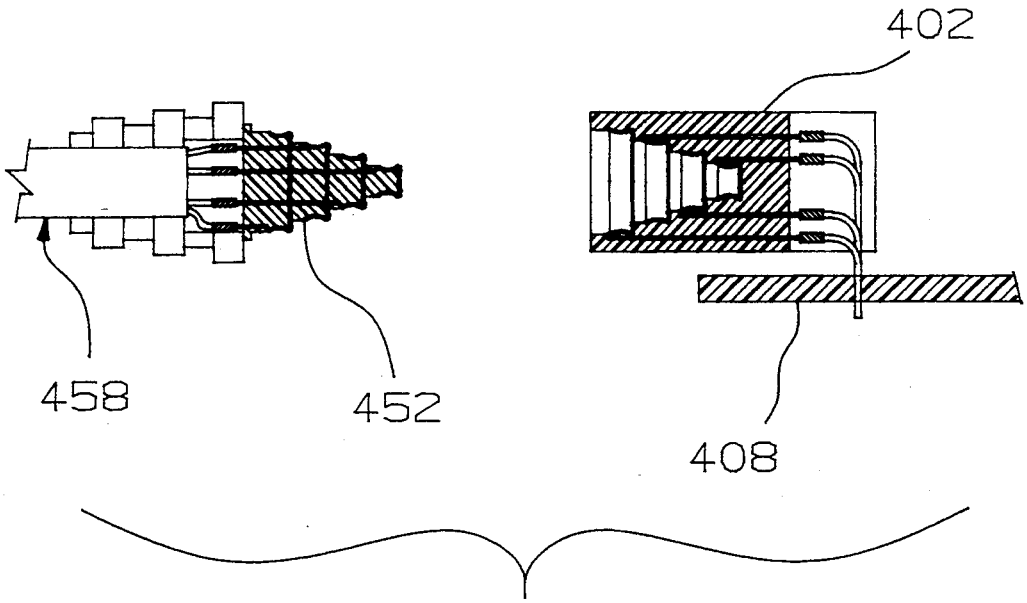

FIG. 13 is a cross-sectional view of a cable to printed circuit board (PCB) application, in which the male connector of the 360° connector system is connected to the cable and the female connector is stationary on the PCB.

Figure 14:
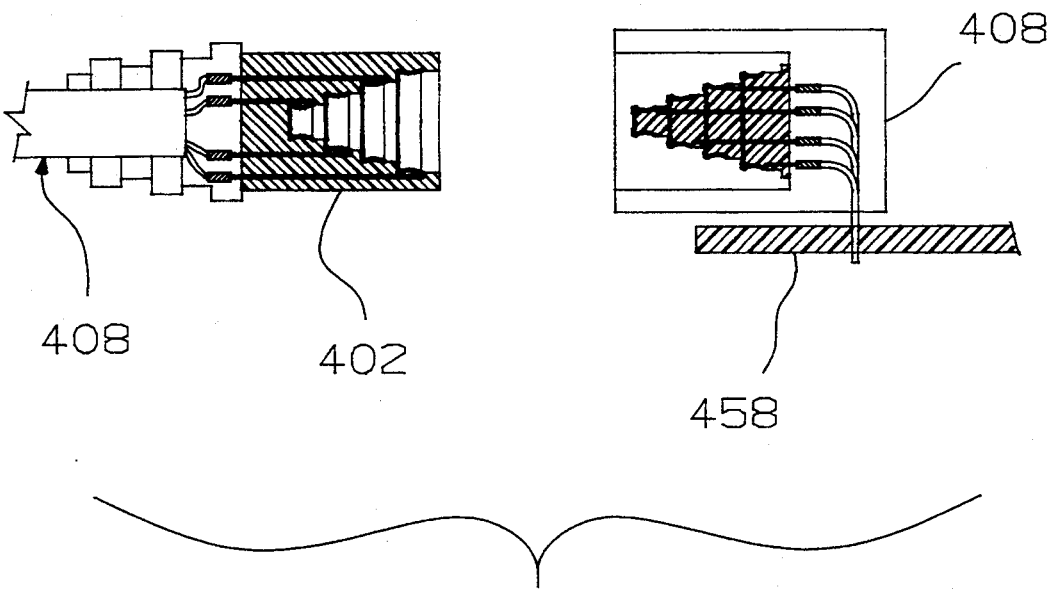

FIG. 14 is a cross-sectional view of the cable to PCB application, in which the female connector of the 360° connector system is connected to the cable and the male connector is stationary on the PCB.

Figure 15:
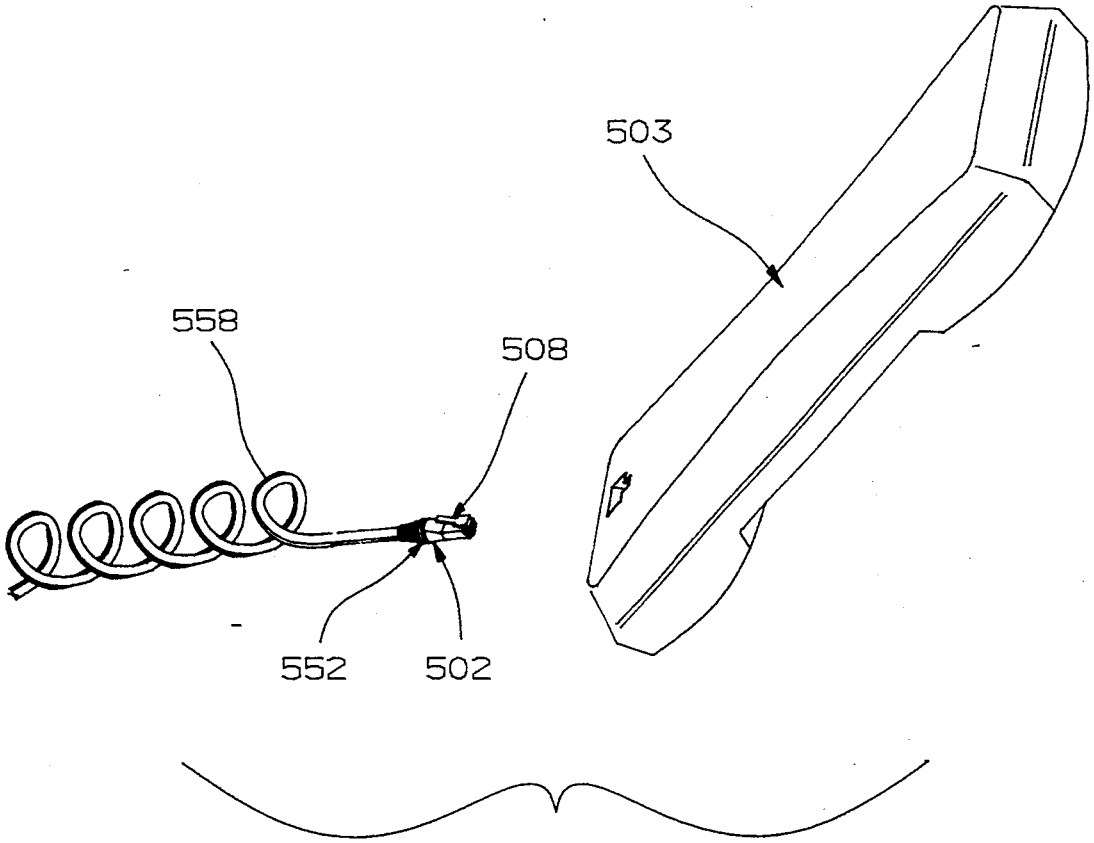

FIG. 15 is a perspective view of the 360° connector system utilized in a telephone application.

Figure 16:
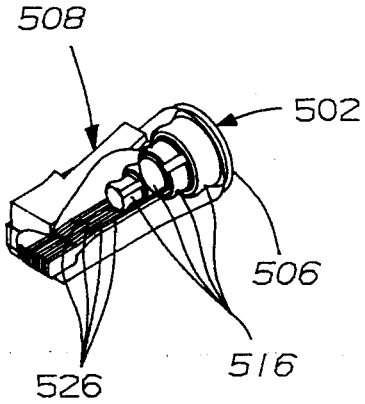

FIG. 16 is a partially cut-out perspective view of the female connector connected to a conventional radio jack.

Figure 17:
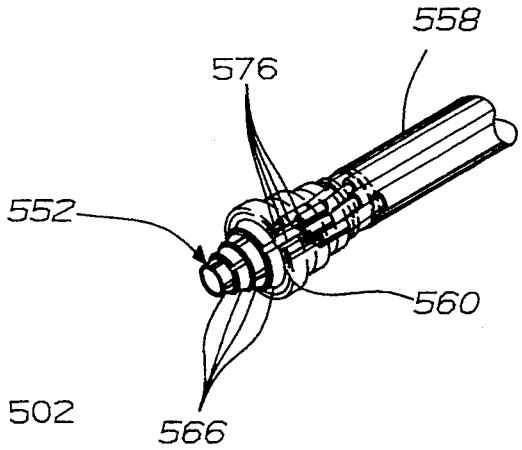

FIG. 17 is a perspective view of the male connector connected to a cable.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described generally, the present invention is a 360° connector system such that a male connector is detachably attachable to a female connector and both connectors of the connector system can be turned freely in a transverse plane. The uniqueness of the connector system is the utilization of concave/convex longitudinal tubular surfaces and transverse circular surfaces of the male and female connectors for improved area contact. Both of the male and female connectors are generally made of an elastomer material, instead of the standard static material used in the prior art swivel devices.

Referring to FIGS. 1 and 2, there is shown a preferred embodiment of the present invention 360° connector system comprising a male connector 52 which is detachably attachable to a female connector 2. The present invention connector system is used as an in-line cable to cable application, as illustrated. The connector system allows for two (2) to ten (10) or more contacts depending on the diameter of the cable. The rotation of connector system occurs when sufficient pressure is imposed on the cable and connector to turn.

Referring to FIGS. 1 and 5 there is shown the female connector 2 comprising a generally elongated cylindrical resilient body or member. The elongated cylindrical resilient body includes a front end 4, a rear end 6 with a lip portion 10 and a generally hollow interior truncated cone shaped or frustum shaped chamber 12. The hollow interior frustum shaped chamber 12 has a circumferential sidewall with three stepped convex sections 14. Each stepped convex section increases proportionally in size from the front end 4 to the rear end 6 of the elongated cylindrical resilient body of the female connector 2.

Referring to FIGS. 1, 3, 3*a* and 5, the three stepped convex sections 14 of the hollow interior frustum shaped chamber 12 have three corresponding stamped ring plates or discs 16 which are respectively conformed and integrally molded onto the three stepped convex sections 14. Each stamped ring plate 16 has a longitudinal convex tubular surface 20 and a transverse circular surface 22 for improved area contact. The longitudinal convex tubular surfaces 20 are preferably split into four segments 24, but can be also split into at least two segments 24, as illustrated in FIG. 3*a*, or without segments so that the elongated cylindrical resilient body can expand inwardly for improved area contact. Each stamped ring plate 16 has a corresponding elongated pin 26 which projects forwardly towards the front end 4 of the female connector 2. Each of the elongated pins 26 has a proximal end 28 and a distal end 30 with a receiving member 32, where the proximal ends 28 are respectively connected to the three stamped ring plates 16. The cable 8 is integrally molded to the front end 4 of the female connector 2 such that the receiving members 32 at the distal ends 30 of the three elongated pins 26 are respectively connected to the cable wires.

Referring to FIGS. 2 and 6, there is shown the male connector 52 comprising a generally elongated resilient cone shaped body or member. The elongated resilient cone shaped body includes a rear end 56, a front end 54 and a circumferential sidewall. The circumferential sidewall includes three stepped concave sections 64 which increase proportionally in size from the front end 54 to the rear end 56 of the male connector 52.

Referring to FIGS. 2, 4, 4*a* and 6, there is shown three corresponding stamped ring plates or discs 66 which are conformed and integrally molded onto the three stepped concave sections 64 of the circumferential sidewall respectively. Each stamped ring plate 66 has a longitudinal concave tubular surface 70 and a transverse circular surface 72 for improved area contact. The longitudinal concave tubular surfaces 70 are preferably split into four segments 74, but can be also split into at least two segments 74 or without segments, as illustrated in FIG. 4*a*, so that the elongated resilient cone shaped body can expand outwardly for improved area contact. Each stamped ring plate 66 has a corresponding elongated pin 76 which projects rearwardly towards the rear end 56 of the male connector 52. Each of the elongated pins 76 has a proximal end 78 and a distal end 80 with a receiving member 82, where the proximal ends 78 are respectively connected to the three stamped ring plates 66. The cable 58 is integrally molded to the rear end 56 of the male connector 52 such that the receiving members 82 at the distal ends 80 of the three elongated pins 76 are respectively connected to the cable wires. There is an annular recess 60 facing forwardly and located at the rear end 56 of the male connector 52, where the rear end 6 of the elongated cylindrical resilient body of the female connector 2 seats.

Referring to FIGS. 1, 2, 5 and 6, the operation of the foregoing embodiment now will be described. The male connector 52 is detachably attachable to the female connector 2. The elongated resilient cone shaped body of the male connector 52 is inserted into the hollow interior frustum shaped chamber 12 of the elongated cylindrical resilient body of the female connector 2 such that the annular recess 60 of the elongated resilient cone shaped body of the male connector 52 receives the lip portion 10 of the elongated cylindrical resilient body of the female connector 2. The longitudinal concave tubular surfaces 70 and the transverse circular surfaces 72 of the three stamped ring plates 66 of the male connector 52 engage with the longitudinal convex tubular surfaces 20 and the transverse circular surfaces 22 of the three stamped ring plates 16 of the female connector 2 respectively. The elongated resilient cone shaped body of the male connector 52 expands outwardly for securely contacting the three stamped ring plates 66 with the complementary stamped ring plates 16 of the female connector 2, thereby making continuity and allowing the 360° connector system to turn around freely in a 360° rotation.

The male connector 52 and the female connector 2 of the connector system can be made from several materials. The manufacturing process which could accommodate the construction of the connector system can be injection, cast, extruded of thermoformed from elastomeric theroset materials, or other molding processes. The 360° connector system is preferably made by a manufacturing process called molded in place. By way of example, the male connector 52 and the female connector 2 are preferably constructed of semi-rubber material or elastomer material, and therefore, can accommodate round or rectangular cables. However, both the male connector 52 and the female connector 2 can be made of any suitable semi-soft material in order to provide significant strain relief and insulation. By being made of semi-rubber or other elastic material, the male connector 52 will be expanding outwardly like a spring and the female connector 2 will be expanding inwardly like a spring at a variety of different angles to be in constant contact with each other to avoid continuity failure. The molding and mass production process would enable the connector system to be produced inexpensively.

The stamped ring plates 16 and 66 on both the female connector 2 and the male connector 52 are preferably made of metal material or any other suitable material to provide conductivity.

It will be appreciated that the present invention 360° connector system is not limited to the in-line cable to cable application as described in detail above. It is emphasized that while the in-line cable to cable application is illustrated, it is also within the spirit and scope of the present invention to have various applications incorporated with the 360° connector system such as a cable to chassis or chassis to cable.

Referring to FIGS. 7 and 8, there is shown the present invention 360° connector system which the concave surfaces on the male connector 52 and the convex surfaces on the female connector 2 are reversed respectively. It will be appreciated that the present invention 360° connector system is not limited to concave surfaces on the male connector 52 and the convex surfaces on the female connector 2 as described in detail above. It is emphasized that while the concave surfaces on the male connector 52 and the convex surfaces on the female connector 2 are preferred, it is also within the spirit and scope of the present invention to reverse the surfaces on both the male and female connectors 52 and 2 such that the male connector 52 has the convex surfaces and the female connector 2 has the concave surfaces. The male connector 52 and the female connector 2 are similar to that in the preceding embodiment, and the description thereof will not be repeated.

Referring to FIG. 9, there is shown another preferred embodiment of the present invention 360° connector system comprising a male connector 152 which is detachably attachable to a female connector 102. Since it is functionally the same as previously described above, the parts are numbered correspondingly with 100 added to each reference number. In this embodiment, the 360° connector system is substantially identical to the preferred embodiment, and to the extent they are, and since the application is a cable 158 to a wall outlet 108, only the added components will be described in detail below.

The male connector 152 is integrally molded to the cable 158, as illustrated in FIGS. 2, 4 and 6. The female connector 102 is integrally molded to the wall outlet 108. The wall outlet 108 includes a panel 109 with an opening 103 such that the rear end of the elongated cylindrical resilient body is integrally mounted through the opening 103 of the wall outlet 108. The receiving members at the distal ends of the elongated pins are respectively connected to the wires of the wall outlet 108.

Referring to FIG. 10, there is shown another preferred embodiment of the present invention 360° connector system comprising a female connector 202 which is detachably attachable to a male connector 252. Since it is functionally the same as previously described above, the parts are numbered correspondingly with 200 added to each reference number. In this embodiment, the 360° connector system is substantially identical to the preferred embodiment, and to the extent they are, and since the application is a power sander unit 258 to a cable 208, only the added components will be described in detail below.

The female connector 202 is integrally molded to the cable 208, as illustrated in FIGS. 1, 3 and 5. The male connector 252 is integrally molded to the power sander unit 258. The power sander unit 258 includes an opening 203 for receiving and connecting the male connector 252 to the sander unit 258. The rear end of the elongated resilient cone shaped body is integrally mounted through the opening 203 of the sander unit 258. The receiving members at the distal ends of the elongated pins are connected respectively to the wires of the sander unit 258.

Referring to FIG. 11, there is shown another preferred embodiment of the present invention 360° connector system comprising a male connector 352 which is detachably attachable to a female connector 302. Since it is functionally the same as previously described above, the parts are numbered correspondingly with 300 added to each reference number. In this embodiment, the 360° connector system is substantially identical to the preferred embodiment, to the extent they are, and since the application is a cable 358 to a chassis 308, only the added components will be described in detail below.

The male connector 352 is integrally molded to the cable 358, as illustrated in FIGS. 2, 4 and 6. The chassis 308 includes an opening 303 for receiving and connecting the female connector 302 to the chassis 308. The rear end of the elongated cylindrical resilient body is integrally mounted through the opening 303 of the chassis 308. The receiving members at the distal ends of the elongated pins are respectively connected to the wires of the chassis 308.

Referring to FIG. 12, there is shown another preferred embodiment of the present invention 360° connector system comprising a female connector 302 which is detachably attachable to a male connector 352. The 360° connector system is similar to that in the preceding embodiment, as illustrated in FIG. 11, except that the male connector 352 and the female connector 302 are reversed, and the description thereof will not be repeated.

Referring to FIG. 13, there is shown another preferred embodiment of the present invention 360° connector system comprising a male connector 452 which is detachably attachable to a female connector 402. Since it is functionally the same as previously described above, the parts are numbered correspondingly with 400 added to each reference number. In this embodiment, the 360° connector system is substantially identical to the preferred embodiment, and to the extent they are, and since the application is a cable 458 to a PCB 408, only the added components will be described in detail below.

The male connector 452 is integrally molded to the cable 458, as illustrated in FIGS. 2, 4 and 6. The elongated cylindrical resilient body of the female connector 402 is integrally mounted to the PCB 408. The receiving members at the distal ends of the elongated pins are respectively connected to the wires of the PCB 408.

Referring to FIG. 14, there is shown another preferred embodiment of the present invention 360° connector system comprising a female connector 402 which is detachably attachable to a male connector 452. The 360° connector system is similar to that in the preceding embodiment, as illustrated in FIG. 11, except that the male connector 452 and the female connector 402 are reversed, and the description thereof will not be repeated.

Referring to FIG. 15, there is shown another preferred embodiment of the present invention 360° connector system comprising a male connector 552 which is detachably attachable to a female connector 502. Since it is functionally the same as previously described above, the parts are numbered correspondingly with 500 added to each reference number. In this embodiment, the 360° connector system is utilized as a radio jack 508 to a cable 558 application.

Referring to FIG. 16, there is shown the female connector 502 comprising a generally elongated cylindrical resilient body or member. The elongated cylindrical resilient body includes a front end, a rear end 506 with a lip portion 510 and a generally hollow interior truncated cone shaped or frustum shaped chamber. The hollow interior frustum shaped chamber has a circumferential sidewall with three stepped convex sections. Each stepped convex section increases proportionally in size from the front end to the rear end 506 of the elongated cylindrical resilient body of the female connector 502.

The three stepped convex sections of the hollow interior frustum shaped chamber have three corresponding stamped ring plates or discs 516 which are respectively conformed and integrally molded onto the three stepped convex sections. Each stamped ring plate 516 has a longitudinal convex tubular surface and a transverse circular surface for improved area contact. The longitudinal convex tubular surfaces are preferably split into four segments, but can be also split into at least two segments or without segments so that the elongated cylindrical resilient body can expand inwardly for improved area contact. Each stamped ring plate 516 has a corresponding elongated pin 526 which projects forwardly towards the front end of the female connector 502. Each of the elongated pins 526 has a proximal end and a distal end with a receiving member, where the proximal ends are connected respectively to the three stamped ring plates 516. The radio jack 508 is integrally molded to the front end of the female connector 502 such that the receiving members at the distal ends of the three elongated pins 526 are connected respectively to the radio jack 508.

Referring to FIG. 17, there is shown the male connector 552 comprising a generally elongated resilient cone shaped body or member. The elongated resilient cone shaped body includes a rear end, a front end and a circumferential sidewall. The circumferential sidewall includes three stepped concave sections which increase proportionally in size from the front end to the rear end of the male connector 552.

Three corresponding stamped ring plates or discs 566 are conformed and integrally molded onto the three stepped concave sections of the circumferential sidewall respectively. Each stamped ring plate 566 has a longitudinal concave tubular surface and a transverse circular surface for improved area contact. The longitudinal concave tubular surfaces are preferably split into four segments, but can be also split into at least two segments or without segments so that the elongated resilient cone shaped body can expand outwardly for improved area contact. Each stamped ring plate 566 has a corresponding elongated pin 576 which projects rearwardly towards the rear end of the male connector 552. Each of the elongated pins 576 has a proximal end and a distal end with a receiving member, where the proximal ends are connected respectively to the three stamped ring plates 566. The cable 558 is integrally molded to the rear end of the male connector 552 such that the receiving members at the distal ends 580 of the three elongated pins 576 are connected respectively to the cable wires. There is an annular recess 560 facing forwardly and located at the rear end of the male connector 552, where the rear end of the elongated cylindrical resilient body of the female connector 502 seats.

Referring to FIGS. 15, 16 and 17, the operation of the foregoing embodiment now will be described. The male connector 552 is detachably attachable to the female connector 502. The elongated resilient cone shaped body of the male connector 552 is inserted into the hollow interior frustum shaped chamber of the elongated cylindrical resilient body of the female connector 502 such that the annular recess 560 of the elongated resilient cone shaped body of the male connector 552 receives the lip portion 510 of the elongated cylindrical resilient body of the female connector 502. The longitudinal concave tubular surfaces and the transverse circular surfaces of the three stamped ring plates 566 of the male connector 552 engage with the longitudinal convex tubular surfaces and the transverse circular surfaces of the three stamped ring plates 51 6 of the female connector 502 respectively. The elongated resilient cone shaped body of the male connector 552 is expanding outwardly for securely contacting the three stamped ring plates 566 with the complementary stamped ring plates 516 of the female connector 502, thereby making continuity and allowing the 360° connector system to turn around freely in a 360° rotation.

The 360° connector system can be used in many applications such as illustrated in FIGS. 7 through 17.

The present invention has many advantageous features including: (a) it is not highly mechanical; (b) it provides an improved area continuity at a multiplicity of surfaces; and (c) it is inexpensive to manufacture.

Defined in detail, the present invention is a 360° connector system for making electrical continuity, comprising:

a. a male connector further comprising,
   (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body,
   (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body,
   (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member,
   (iv) an annular recess facing forwardly and located adjacent to said rear end of said elongated resilient cone shaped body;

b. a female connector further comprising,
   (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body,
   (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body,
   (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member,
   (iv) a lip portion facing rearwardly and located adjacent to said rear end of said elongated cylindrical resilient body; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates with said multiplicity of complementary stamped ring plates of said female connector, thereby creating electrical continuity and allowing said connector system to turn around freely in a 360° rotation.

Also defined in detail, the present invention is a 360° connector system used in conjunction with a first cable having a multiplicity of wires and a second cable having a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said first cable integrally molded onto said rear end of said elongated resilient cone shaped body such that a respective one of said receiving members of said multiplicity of elongated pins are respectively connected to a respective one of said multiplicity of wires of said first cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said second cable integrally molded onto said front end of said elongated cylindrical resilient body such that said receiving members of said multiplicity of elongated pins are respectively connected to a respective one of said multiplicity of wires of said second cable; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

Additionally defined in detail, the present invention is a 360° connector system used in conjunction with a cable having a multiplicity of wires and a wall outlet having a multiplicity of wires and an opening, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are respectively connected to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said rear end of said elongated cylindrical resilient body integrally mounted through said opening of said wall outlet such that said receiving members of said multiplicity of elongated pins are respectively connected to a respective one of said multiplicity of wires of said wall outlet; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

Further defined in detail, the present invention is a 360° connector system used in conjunction with a cable having a multiplicity of wires and a device having a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said rear end of said elongated cylindrical resilient body integrally mounted to said device such that a respective one of said receiving member of said multiplicity of elongated pins are connected respectively to a respective one of said multiplicity of wires of said device;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongate pin having a receiving member, (iv) a lip portion facing rearwardly and located adjacent to said rear end of said elongated cylindrical resilient body, (v) said cable integrally molded onto said front end of said elongated cylindrical resilient body such that said receiving members of said multiplicity of elongated pins are respectively connected to a respective one of said multiplicity of wires of said cable; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

Also further defined in detail, the present invention is a 360° connector system used in conjunction with a cable having a multiplicity of wires and a chassis having an opening and a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are respectively connected to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said rear end of said elongated cylindrical resilient body integrally mounted through said opening of said chassis such that said receiving members of said multiplicity of elongated pins are respectively connected to a respective one of said multiplicity of wires of said chassis; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

Additionally further defined in detail, the present invention is a 360° connector system used in conjunction with a cable having a multiplicity of wires and a PCB having a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are connected respectively to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said elongated cylindrical resilient body integrally mounted to said PCB such that said receiving member of said multiplicity of elongated pins are respectively connected to a respective one of said multiplicity of wires of said PCB; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

Still further defined in detail, the present invention is a 360° connector system used in conjunction with a cable having a multiplicity of wires and a radio jack having a rear end and a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are respectively connected to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said elongated cylindrical resilient body integrally molded to said rear end of said radio jack such that said receiving member of said multiplicity of elongated pins are respectively connected to a respective one of said multiplicity of wires of said radio jack; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

Defined broadly, the present invention is a connector system for making electrical continuity, comprising:

a. a male connector further comprising, (i) a resilient cone shaped member having a rear end, a sidewall and a front end, the sidewall having a stepped concave section, (ii) a stamped disc having a longitudinal concave surface and a transverse surface, the longitudinal concave surface split into at least two segments, the stamped disc molded onto said stepped concave section of said sidewall of said resilient cone shaped member, (iii) a pin projecting rearwardly from said rear end of said resilient cone shaped member, the pin having a proximal end and a distal end, the proximal end connected to said stamped disc;

b. a female connector further comprising, (i) a resilient member having a rear end, a front end and a hollow frustum shaped chamber, where the hollow frustum shaped chamber forms a stepped convex section, (ii) a complementary stamped disc having a longitudinal convex surface and a transverse surface, the longitudinal convex surface split into at least two segments, the complementary stamped disc molded onto said stepped convex section of said hollow frustum shaped chamber of said resilient member, (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal concave surface and said transverse surface of said stamped disc of said resilient cone shaped member of said male connector engage with said longitudinal convex surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

Defined more broadly, the present invention is a connector system for making electrical continuity, comprising:

a. a male connector further comprising, (i) a resilient cone shaped member having a rear end, a sidewall and a front end, the sidewall having a stepped concave section, (ii) a stamped disc having a longitudinal concave surface and a transverse surface, the stamped disc molded onto said stepped concave section of said sidewall of said resilient cone shaped member, (iii) a pin projecting rearwardly from said rear end of said resilient cone shaped member, the pin having a proximal end and a distal end, the proximal end connected to said stamped disc;

b. a female connector further comprising, (i) a resilient member having a rear end, a front end and a hollow frustum shaped chamber, where the hollow frustum shaped chamber forms a stepped convex section, (ii) a complementary stamped disc having a longitudinal convex surface and a transverse surface, the complementary stamped disc molded onto said stepped convex section of said hollow frustum shaped chamber of said resilient member, (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal concave surface and said transverse surface of said stamped disc of said resilient cone shaped member of said male connector engage with said longitudinal convex surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

Defined even more broadly, the present invention is a connector system for making electrical continuity, comprising:

a. a male connector further comprising,
   (i) a resilient cone shaped member having a rear end, a sidewall and a front end, the sidewall having a stepped convex section,
   (ii) a stamped disc having a longitudinal convex surface and a transverse surface, the longitudinal convex surface split into at least two segments, the stamped disc molded onto said stepped convex section of said sidewall of said resilient cone shaped member,
   (iii) a pin projecting rearwardly from said rear end of said resilient cone shaped member, the pin having a proximal end and a distal end, the proximal end connected to said stamped disc;

b. a female connector further comprising,
   (i) a resilient member having a rear end, a front end and a hollow frustum shaped chamber, where the hollow frustum shaped chamber forms a stepped concave section,
   (ii) a complementary stamped disc having a longitudinal concave surface and a transverse surface, the longitudinal concave surface split into at least two segments, the complementary stamped disc molded onto said stepped concave section of said hollow frustum shaped chamber of said resilient member,
   (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal convex surface and said transverse surface of said stamped disc of said resilient cone shaped member of said male connector engage with said longitudinal concave surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

Further defined even more broadly, the present invention is a connector system for making electrical continuity, comprising:

a. a male connector further comprising,
   (i) a resilient cone shaped member having a rear end, a sidewall and a front end, the sidewall having a stepped convex section,
   (ii) a stamped disc having a longitudinal convex surface and a transverse surface, the stamped disc molded onto said stepped convex section of said sidewall of said resilient cone shaped member,
   (iii) a pin projecting rearwardly from said rear end of said resilient cone shaped member, the pin having a proximal end and a distal end, the proximal end connected to said stamped disc;

b. a female connector further comprising,
   (i) a resilient member having a rear end, a front end and a hollow frustum shaped chamber, where the hollow frustum shaped chamber forms a stepped concave section,
   (ii) a complementary stamped disc having a longitudinal concave surface and a transverse surface, the complementary stamped disc molded onto said stepped concave section of said hollow frustum shaped chamber of said resilient member,
   (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal convex surface and said transverse surface of said stamped disc of said resilient cone shaped member of said male connector engage with said longitudinal concave surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

Also defined broadly, the present invention is a connector system used in conjunction with a first cable having a multiplicity of wires and a second cable having a multiplicity of wires, comprising:

a. a male connector further comprising,
   (i) a resilient cone shaped member having a rear end, a sidewall and a front end, the sidewall having a multiplicity of stepped concave sections,
   (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member,
   (iii) a multiplicity of pins projecting rearwardly from said rear end of said resilient cone shaped member, each pin having a proximal end and a distal end, a respective one of the proximal ends connected to a respective one of said multiplicity of stamped discs respectively,
   (iv) said first cable integrally molded onto said rear end of said resilient cone shaped member such that a respective one of said distal ends of said multiplicity of pins are respectively connected to a respective one of said multiplicity of wires of said first cable;

b. a female connector further comprising,
   (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said second cable integrally molded onto said front end of said resilient member such that said distal ends of said multiplicity of pins are respectively connected to a respective one of said multiplicity of wires of said second cable; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

Further defined broadly, the present invention is a connector system used in conjunction with a cable having a multiplicity of wires and a panel of a housing structure having an opening and a multiplicity of wires, comprising:

a. a male connector further comprising, (i) a resilient cone shaped member having a rear end, a sidewall and a front end, the sidewall having a multiplicity of stepped concave sections, (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member, (iii) a multiplicity of pins projecting rearwardly from said rear end of said resilient cone shaped member, each pin having a proximal end and a distal end, a respective one of the proximal ends connected to a respective one of said multiplicity of stamped discs respectively, (iv) said cable integrally molded onto said rear end of said resilient cone shaped member such that a respective one of said distal ends of said multiplicity of pins are respectively connected to a respective one of said multiplicity of wires of said cable;

b. a female connector further comprising, (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said rear end of said resilient member integrally mounted through said opening of said panel of said housing structure such that said distal ends of said multiplicity of pins are respectively connected to a respective one of said multiplicity of wires of said panel of said housing structure; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

Also further defined broadly, the present invention is a connector system used in conjunction with a cable having a multiplicity of wires and an electronic circuit of a device having a multiplicity of wires, comprising:

a. a male connector further comprising, (i) a resilient cone shaped member having a rear end, a sidewall and a front end, the sidewall having a multiplicity of stepped concave sections, (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member, (iii) a multiplicity of pins projecting rearwardly from said rear end of said resilient cone shaped member, each pin having a proximal end and a distal end, a respective one of the proximal ends connected to a respective one of said multiplicity of stamped discs respectively, (iv) said resilient cone shaped member integrally mounted to said electronic circuit of said device such that a respective one of said distal ends of said multiplicity of pins are respectively connected to a respective one of said multiplicity of wires of said device;

b. a female connector further comprising, (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said cable integrally molded onto said front end of said resilient member such that said distal ends of said multiplicity of pins are respectively connected to a respective one of said multiplicity of wires of said cable; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

Still further defined broadly, the present invention is a connector system used in conjunction with a cable having a multiplicity of wires and a radio jack having a rear end and a multiplicity of wires, comprising:

a. a male connector further comprising, (i) a resilient cone shaped member having a rear end, a sidewall and a front end, the sidewall having a multiplicity of stepped concave sections, (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member, (iii) a multiplicity of pins projecting rearwardly from said rear end of said resilient cone shaped member, each pin having a proximal end and a distal end, a respective one of the proximal ends connected to a respective one of said multiplicity of stamped discs respectively, (iv) said cable integrally molded onto said rear end of said resilient cone shaped member such that a respective one of said distal ends of said multiplicity of pins are respectively connected to a respective one of said multiplicity of wires of said cable;

b. a female connector further comprising, (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said front end of said resilient member integrally molded to said rear end of said radio jack such that said distal ends of said multiplicity of pins are respectively connected to a respective one of said multiplicity of wires of said radio jack; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A 360° connector system for making electrical continuity, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates with said multiplicity of complementary stamped ring plates of said female connector, thereby creating electrical continuity and allowing said connector system to turn around freely in a 360° rotation.

2. The invention as defined in claim 1 wherein said elongated cylindrical resilient body of said female connector and said elongated resilient cone shaped body of said male connector are made of elastomer material.

3. The invention as defined in claim 1 wherein said female connector and said male connector are manufactured in a molded in place process.

4. The invention as defined in claim 1 wherein said multiplicity of stamped ring plates of said male and female connectors are made of metal material.

5. A 360° connector system used in conjunction with a first cable having a multiplicity of wires and a second cable having a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said first cable integrally molded onto said rear end of said elongated resilient cone shaped body such that a respective one of said receiving members of said multiplicity of elongated pins are respectively connected to a respective one of said multiplicity of wires of said first cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said second cable integrally molded onto said front end of said elongated cylindrical resilient body such that said receiving members of said multiplicity of elongated pins are respectively connected to a respective one of said c. multiplicity of wires of said second cable; and said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

6. The invention as defined in claim 5 wherein said elongated cylindrical resilient body of said female connector and said elongated resilient cone shaped body of said male connector are made of elastomer material.

7. The invention as defined in claim 5 wherein said female connector and said male connector are manufactured in a molded in place process.

8. The invention as defined in claim 5 wherein said multiplicity of stamped ring plates of said male and female connectors are made of metal material.

9. A 360° connector system used in conjunction with a cable having a multiplicity of wires and a wall outlet having a multiplicity of wires and an opening, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are respectively connected to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said rear end of said elongated cylindrical resilient body integrally mounted through said opening of said wall outlet such that said receiving members of said multiplicity of elongated pins are respectively connected to a respective c. one of said multiplicity of wires of said wall outlet; and said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

10. The invention as defined in claim 9 wherein said elongated cylindrical resilient body of said female connector and said elongated resilient cone shaped body of said male connector are made of elastomer material.

11. The invention as defined in claim 9 wherein said female connector and said male connector are manufactured in a molded in place process.

12. The invention as defined in claim 9 wherein said multiplicity of stamped ring plates of said male and female connectors are made of metal material.

13. A 360° connector system used in conjunction with a cable having a multiplicity of wires and a device having a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said rear end of said elongated cylindrical resilient body integrally mounted to said device such that a respective one of said receiving member of said multiplicity of elongated pins are connected respectively to a respective one of said multiplicity of wires of said device;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongate pin having a receiving member, (iv) a lip portion facing rearwardly and located adjacent to said rear end of said elongated cylindrical resilient body, (v) said cable integrally molded onto said front end of said elongated cylindrical resilient body such that said receiving members of said multiplicity of elongated pins are respectively connected to a respective one of said multiplicity of wires of said cable; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

14. The invention as defined in claim 13 wherein said elongated cylindrical resilient body of said female connector and said elongated resilient cone shaped body of said male connector are made of elastomer material.

15. The invention as defined in claim 13 wherein said female connector and said male connector are manufactured in a molded in place process.

16. The invention as defined in claim 13 wherein said multiplicity of stamped ring plates of said male and female connectors are made of metal material.

17. A 360° connector system used in conjunction with a cable having a multiplicity of wires and a chassis having an opening and a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are respectively connected to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said rear end of said elongated cylindrical resilient body integrally mounted through said opening of said chassis such that said receiving members of said multiplicity of elongated pins are respectively connected to a respective one of said multiplicity of wires of said chassis; and said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

18. The invention as defined in claim 17 wherein said elongated cylindrical resilient body of said female connector and said elongated resilient cone shaped body of said male connector are made of elastomer material.

19. The invention as defined in claim 17 wherein said female connector and said male connector are manufactured in a molded in place process.

20. The invention as defined in claim 17 wherein said multiplicity of stamped ring plates of said male and female connectors are made of metal material.

21. A 360° connector system used in conjunction with a cable having a multiplicity of wires and a PCB having a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are connected respectively to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said elongated cylindrical resilient body integrally mounted to said PCB such that said receiving member of said multiplicity of elongated pins are respectively connected to a respective one of said multiplicity of wires of said PCB; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

22. The invention as defined in claim 21 wherein said elongated cylindrical resilient body of said female connector and said elongated resilient cone shaped body of said male connector are made of elastomer material.

23. The invention as defined in claim 21 wherein said female connector and said male connector are manufactured in a molded in place process.

24. The invention as defined in claim 21 wherein said multiplicity of stamped ring plates of said male and female connectors are made of metal material.

25. A 360° connector system used in conjunction with a cable having a multiplicity of wires and a radio jack having a rear end and a multiplicity of wires, comprising:

a. a male connector further comprising, (i) a generally elongated resilient cone shaped body having a rear end, a circumferential sidewall and a front end, the circumferential sidewall having a multiplicity of stepped concave sections increasing proportionally in size from the front end to the rear end of the elongated resilient cone shaped body, (ii) a multiplicity of stamped ring plates each having a longitudinal concave tubular surface and a transverse circular surface, the longitudinal concave tubular surfaces split into a multiplicity of segments, each stamped ring plate molded onto a respective one of said multiplicity of said stepped concave sections of said circumferential sidewall of said elongated resilient cone shaped body, (iii) a multiplicity of elongated pins projecting rearwardly from said rear end of said elongated resilient cone shaped body, each elongated pin having a proximal end and a distal end, a respective one of the proximal ends connected to a respective one of said multiplicity of stamped ring plates respectively, the distal ends of each elongated pin having a receiving member, (iv) an annular recess facing forwardly and located adjacent to said rear end of said elongated resilient cone shaped body, (v) said cable integrally molded onto said rear end of said elongated resilient cone shaped body such that a respective one of said receiving members of said multiplicity of elongated pins are respectively connected to a respective one of said multiplicity of wires of said cable;

b. a female connector further comprising, (i) a generally elongated cylindrical resilient body having a rear end, a front end and a hollow interior frustum shaped chamber, where the hollow interior frustum shaped chamber forms a multiplicity of stepped convex sections increasing proportionally in size from the front end to the rear end of the elongated cylindrical resilient body, (ii) a multiplicity of complementary stamped ring plates each having a longitudinal convex tubular surface and a transverse circular surface, the longitudinal convex tubular surfaces split into a multiplicity of segments, each stamped ring plate molded onto a respective one of said multiplicity of stepped convex sections of said hollow interior frustum shaped chamber of said elongated cylindrical resilient body, (iii) a multiplicity of elongated pins projecting forwardly from said front end of said elongated cylindrical resilient body, each elongated pin having a proximal end and a distal end, a respective one of the proximal ends connected to a respective one of said multiplicity of stamped ring plates respectively, the distal ends of each elongated pin having a receiving member, (iv) a lip portion facing rearwardly and located adjacent to said rear end of said elongated cylindrical resilient body, (v) said elongated cylindrical resilient body integrally molded to said rear end of said radio jack such that said receiving member of said multiplicity of elongated pins are respectively connected to a respective one of said multiplicity of wires of said radio jack; and c. said male connector detachably attachable to said female connector, where said elongated resilient cone shaped body of said male connector is inserted into said hollow interior frustum shaped chamber of said elongated cylindrical resilient body of said female connector such that said annular recess of said elongated resilient cone shaped body of said male connector receives said lip portion of said elongated cylindrical resilient body of said female connector, said longitudinal concave tubular surfaces and said transverse circular surfaces of said multiplicity of stamped ring plates of said elongated resilient cone shaped body of said male connector engage with said longitudinal convex tubular surfaces and said transverse circular surfaces of said multiplicity of stamped ring plates of said elongated cylindrical resilient body of said female connector respectively, said elongated resilient cone shaped body of said male connector expanding outwardly for securely contacting said multiplicity of stamped ring plates to said multiplicity of complementary stamped ring plates of said female connector, thereby creating electrical continuity and allowing said connector system to turn around freely in a 360° rotation.

26. The invention as defined in claim 25 wherein said elongated cylindrical resilient body of said female connector and said elongated resilient cone shaped body of said male connector are made of elastomer material.

27. The invention as defined in claim 25 wherein said female connector and said male connector are manufactured in a molded in place process.

28. The invention as defined in claim 25 wherein said multiplicity of stamped ring plates of said male and female connectors are made of metal material.

29. A connector system for making electrical continuity, comprising:

a. a male connector further comprising, (i) a resilient cone shaped member having a rear end, a sidewall and a front end, the sidewall having a stepped concave section, (ii) a stamped disc having a longitudinal concave surface and a transverse surface, the longitudinal concave surface split into at least two segments, the stamped disc molded onto said stepped concave section of said sidewall of said resilient cone shaped member, (iii) a pin projecting rearwardly from said rear end of said resilient cone shaped member, the pin having a proximal end and a distal end, the proximal end connected to said stamped disc;

b. a female connector further comprising, (i) a resilient member having a rear end, a front end and a hollow frustum shaped chamber, where the hollow frustum shaped chamber forms a stepped convex section, (ii) a complementary stamped disc having a longitudinal convex surface and a transverse surface, the longitudinal convex surface split into at least two segments, the complementary stamped disc molded onto said stepped convex section of said hollow frustum shaped chamber of said resilient member, (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal concave surface and said transverse surface of said stamped disc of said resilient cone shaped member of said male connector engage with said longitudinal convex surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

30. The invention as defined in claim 29 further comprising an annular recess facing forwardly and located adjacent to said rear end of said resilient cone shaped member of said male connector.

31. The invention as defined in claim 29 further comprising a lip portion facing rearwardly and located adjacent to said rear end of said resilient member of said female connector, where said annular recess of said resilient cone shaped member of said male connector receives the lip portion of said resilient member of said female connector.

32. The invention as defined in claim 29 wherein said resilient member of said female connector and said resilient cone shaped member of said male connector are made of elastomer material.

33. The invention as defined in claim 29 wherein said female connector and said male connector are manufactured in a molded in place process.

34. The invention as defined in claim 29 wherein said stamped disc and said complementary stamped disc are made of metal material.

35. A connector system for making electrical continuity, comprising:

a. a male connector further comprising, (i) a resilient cone shaped member having a rear end, a sidewall and a front end, the sidewall having a stepped concave section, (ii) a stamped disc having a longitudinal concave surface and a transverse surface, the stamped disc molded onto said stepped concave section of said sidewall of said resilient cone shaped member, (iii) a pin projecting rearwardly from said rear end of said resilient cone shaped member, the pin having a proximal end and a distal end, the proximal end connected to said stamped disc;

b. a female connector further comprising, (i) a resilient member having a rear end, a front end and a hollow frustum shaped chamber, where the hollow frustum shaped chamber forms a stepped convex section, (ii) a complementary stamped disc having a longitudinal convex surface and a transverse surface, the complementary stamped disc molded onto said stepped convex section of said hollow frustum shaped chamber of said resilient member, (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal concave surface and said transverse surface of said stamped disc of said resilient cone shaped member of said male connector engage with said longitudinal convex surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

36. The invention as defined in claim 35 further comprising an annular recess facing forwardly and located adjacent to said rear end of said resilient cone shaped member of said male connector.

37. The invention as defined in claim 35 further comprising a lip portion facing rearwardly and located adjacent to said rear end of said resilient member of said female connector, where said annular recess of said resilient cone shaped member of said male connector receives the lip portion of said resilient member of said female connector.

38. The invention as defined in claim 35 wherein said resilient member of said female connector and said resilient cone shaped member of said male connector are made of elastomer material.

39. The invention as defined in claim 35 wherein said female connector and said male connector are manufactured in a molded in place process.

40. The invention as defined in claim 35 wherein said stamped disc and said complementary stamped disc are made of metal material.

41. A connector system for making electrical continuity, comprising:

a. a male connector further comprising, (i) a resilient cone shaped member having a rear end, a sidewall and a front end, the sidewall having a stepped convex section, (ii) a stamped disc having a longitudinal convex surface and a transverse surface, the longitudinal convex surface split into at least two segments, the stamped disc molded onto said stepped convex section of said sidewall of said resilient cone shaped member, (iii) a pin projecting rearwardly from said rear end of said resilient cone shaped member, the pin having a proximal end and a distal end, the proximal end connected to said stamped disc;

b. a female connector further comprising, (i) a resilient member having a rear end, a front end and a hollow frustum shaped chamber, where the hollow frustum shaped chamber forms a stepped concave section, (ii) a complementary stamped disc having a longitudinal concave surface and a transverse surface, the longitudinal concave surface split into at least two segments, the complementary stamped disc molded onto said stepped concave section of said hollow frustum shaped chamber of said resilient member, (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal convex surface and said transverse surface of said stamped disc of said resilient cone shaped member of said male connector engage with said longitudinal concave surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

42. The invention as defined in claim 41 further comprising an annular recess facing forwardly and located adjacent to said rear end of said resilient cone shaped member of said male connector.

43. The invention as defined in claim 41 further comprising a lip portion facing rearwardly and located adjacent to said rear end of said resilient member of said female connector, where said annular recess of said resilient cone shaped member of said male connector receives the lip portion of said resilient member of said female connector.

44. The invention as defined in claim 41 wherein said resilient member of said female connector and said resilient cone shaped member of said male connector are made of elastomer material.

45. The invention as defined in claim 41 wherein said female connector and said male connector are manufactured in a molded in place process.

46. The invention as defined in claim 41 wherein said stamped disc and said complementary stamped disc are made of metal material.

47. A connector system for making electrical continuity, comprising:

a. a male connector further comprising, (i) a resilient cone shaped member having a rear end, a sidewall and a front end, the sidewall having a stepped convex section, (ii) a stamped disc having a longitudinal convex surface and a transverse surface, the stamped disc molded onto said stepped convex section of said sidewall of said resilient cone shaped member, (iii) a pin projecting rearwardly from said rear end of said resilient cone shaped member, the pin having a proximal end and a distal end, the proximal end connected to said stamped disc;

b. a female connector further comprising, (i) a resilient member having a rear end, a front end and a hollow frustum shaped chamber, where the hollow frustum shaped chamber forms a stepped concave section, (ii) a complementary stamped disc having a longitudinal concave surface and a transverse surface, the complementary stamped disc molded onto said stepped concave section of said hollow frustum shaped chamber of said resilient member, (iii) a pin projecting forwardly from said front end of said resilient body, the pin having a proximal end and a distal end, the proximal end connected to said complementary stamped disc; and c. said male connector detachably attachable to said female connector, where said resilient cone shaped member of said male connector is inserted into said hollow frustum shaped chamber of said resilient member of said female connector such that said longitudinal convex surface and said transverse surface of said stamped disc of said resilient cone shaped member of said male connector engage with said longitudinal concave surface and said transverse surface of said stamped disc of said resilient member of said female connector, said resilient cone shaped member of said male connector expanding outwardly for securely contacting said stamped disc with said complementary stamped disc of said female connector, thereby creating electrical continuity and allowing said connector system to turn around freely in a 360° rotation.

48. The invention as defined in claim 47 further comprising an annular recess facing forwardly and located adjacent to said rear end of said resilient cone shaped member of said male connector.

49. The invention as defined in claim 47 further comprising a lip portion facing rearwardly and located adjacent to said rear end of said resilient member of said female connector, where said annular recess of said resilient cone shaped member of said male connector receives the lip portion of said resilient member of said female connector.

50. The invention as defined in claim 47 wherein said resilient member of said female connector and said resilient cone shaped member of said male connector are made of elastomer material.

51. The invention as defined in claim 47 wherein said female connector and said male connector are manufactured in a molded in place process.

52. The invention as defined in claim 47 wherein said stamped disc and said complementary stamped disc are made of metal material.

53. A connector system used in conjunction with a first cable having a multiplicity of wires and a second cable having a multiplicity of wires, comprising:

a. a male connector further comprising, (i) a resilient cone shaped member having a rear end, a sidewall and a front end, the sidewall having a multiplicity of stepped concave sections, (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member, (iii) a multiplicity of pins projecting rearwardly from said rear end of said resilient cone shaped member, each pin having a proximal end and a distal end, a respective one of the proximal ends connected to a respective one of said multiplicity of stamped discs respectively, (iv) said first cable integrally molded onto said rear end of said resilient cone shaped member such that a respective one of said distal ends of said multiplicity of pins are respectively connected to a respective one of said multiplicity of wires of said first cable;

b. a female connector further comprising, (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said second cable integrally molded onto said front end of said resilient member such that said distal ends of said multiplicity of pins are respectively connected to a respective one of said multiplicity of wires of said second cable; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

54. The invention as defined in claim 53 further comprising an annular recess facing forwardly and located adjacent to said rear end of said resilient cone shaped member of said male connector.

55. The invention as defined in claim 53 further comprising a lip portion facing rearwardly and located adjacent to said rear end of said resilient member of said female connector, where said annular recess of said resilient cone shaped member of said male connector receives the lip portion of said resilient member of said female connector.

56. The invention as defined in claim 53 wherein said resilient member of said female connector and said resilient cone shaped member of said male connector are made of elastomer material.

57. The invention as defined in claim 53 wherein said female connector and said male connector are manufactured in a molded in place process.

58. The invention as defined in claim 53 wherein said multiplicity of stamped discs of said male and female connectors are made of metal material.

59. A connector system used in conjunction with a cable having a multiplicity of wires and a panel of a housing structure having an opening and a multiplicity of wires, comprising:

a. a male connector further comprising,
   (i) a resilient cone shaped member having a rear end, a sidewall and a front end, the sidewall having a multiplicity of stepped concave sections,
   (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member,
   (iii) a multiplicity of pins projecting rearwardly from said rear end of said resilient cone shaped member, each pin having a proximal end and a distal end, a respective one of the proximal ends connected to a respective one of said multiplicity of stamped discs respectively,
   (iv) said cable integrally molded onto said rear end of said resilient cone shaped member such that a respective one of said distal ends of said multiplicity of pins are respectively connected to a respective one of said multiplicity of wires of said cable;

b. a female connector further comprising,
   (i) a resilient member having a rear end, a front end and a hollow frustum shaped chamber, where the hollow frustum shaped chamber forms a multiplicity of stepped convex sections,
   (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member,
   (iii) a multiplicity of pins projecting forwardly from said front end of said resilient member, each pin having a proximal end and a distal end, a respective one of the proximal ends connected to a respective one of said multiplicity of stamped discs respectively,
   (iv) said rear end of said resilient member integrally mounted through said opening of said panel of said housing structure such that said distal ends of said multiplicity of pins are respectively connected to a respective one of said multiplicity of wires of said panel of said housing structure; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

60. The invention as defined in claim 59 further comprising an annular recess facing forwardly and located adjacent to said rear end of said resilient cone shaped member of said male connector.

61. The invention as defined in claim 59 further comprising a lip portion facing rearwardly and located adjacent to said rear end of said resilient member of said female connector, where said annular recess of said resilient cone shaped member of said male connector receives the lip portion of said resilient member of said female connector.

62. The invention as defined in claim 59 wherein said resilient member of said female connector and said resilient cone shaped member of said male connector are made of elastomer material.

63. The invention as defined in claim 59 wherein said female connector and said male connector are manufactured in a molded in place process.

64. The invention as defined in claim 59 wherein said multiplicity of stamped discs of said male and female connectors are made of metal material.

65. A connector system used in conjunction with a cable having a multiplicity of wires and an electronic circuit of a device having a multiplicity of wires, comprising:

a. a male connector further comprising,
   (i) a resilient cone shaped member having a rear end, a sidewall and a front end, the sidewall having a multiplicity of stepped concave sections,
   (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member,
   (iii) a multiplicity of pins projecting rearwardly from said rear end of said resilient cone shaped member, each pin having a proximal end and a distal end, a respective one of the proximal ends connected to a respective one of said multiplicity of stamped discs respectively,
   (iv) said resilient cone shaped member integrally mounted to said electronic circuit of said device such that a respective one of said distal ends of said multiplicity of pins are respectively connected to a respective one of said multiplicity of wires of said device;

b. a female connector further comprising, (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said cable integrally molded onto said front end of said resilient member such that said distal ends of said multiplicity of pins are respectively connected to a respective one of said multiplicity of wires of said cable; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

66. The invention as defined in claim 65 further comprising an annular recess facing forwardly and located adjacent to said rear end of said resilient cone shaped member of said male connector.

67. The invention as defined in claim 65 further comprising a lip portion facing rearwardly and located adjacent to said rear end of said resilient member of said female connector, where said annular recess of said resilient cone shaped member of said male connector receives the lip portion of said resilient member of said female connector.

68. The invention as defined in claim 65 wherein said resilient member of said female connector and said resilient cone shaped member of said male connector are made of elastomer material.

69. The invention as defined in claim 65 wherein said female connector and said male connector are manufactured in a molded in place process.

70. The invention as defined in claim 65 wherein said multiplicity of stamped discs of said male and female connectors are made of metal material.

71. A connector system used in conjunction with a cable having a multiplicity of wires and a radio jack having a rear end and a multiplicity of wires, comprising:

a. a male connector further comprising, (i) a resilient cone shaped member having a rear end, a sidewall and a front end, the sidewall having a multiplicity of stepped concave sections, (ii) a multiplicity of stamped discs each having a longitudinal concave surface and a transverse surface, the longitudinal concave surfaces split into at least two segments, each stamped disc molded onto a respective one of said multiplicity of said stepped concave sections of said sidewall of said resilient cone shaped member, (iii) a multiplicity of pins projecting rearwardly from said rear end of said resilient cone shaped member, each pin having a proximal end and a distal end, a respective one of the proximal ends connected to a respective one of said multiplicity of stamped discs respectively, (iv) said cable integrally molded onto said rear end of said resilient cone shaped member such that a respective one of said distal ends of said multiplicity of pins are respectively connected to a respective one of said multiplicity of wires of said cable;

b. a female connector further comprising, (i) a resilient member having a rear end, a front end and a hollow frustum shaped chamber, where the hollow frustum shaped chamber forms a multiplicity of stepped convex sections, (ii) a multiplicity of complementary stamped discs each having a longitudinal convex surface and a transverse surface, the longitudinal convex surfaces split into at least two segments, each stamped disc molded onto a respective one of said multiplicity of stepped convex sections of said hollow frustum shaped chamber of said resilient member, (iii) a multiplicity of pins projecting forwardly from said front end of said resilient member, each pin having a proximal end and a distal end, a respective one of the proximal ends connected to a respective one of said multiplicity of stamped discs respectively, (iv) said front end of said resilient member integrally molded to said rear end of said radio jack such that said distal ends of said multiplicity of pins are respectively connected to a respective one of said multiplicity of wires of said radio jack; and c. said male connector detachably attachable to said female connector, where said resilient cone shaped member of said male connector is inserted into said hollow frustum shaped chamber of said resilient member of said female connector such that said longitudinal concave surfaces and said transverse surfaces of said multiplicity of stamped discs of said resilient cone shaped member of said male connector engage with said longitudinal convex surfaces and said transverse surfaces of said multiplicity of stamped discs of said resilient member of said female connector respectively, said resilient cone shaped member of said male connector expanding outwardly for securely contacting said multiplicity of stamped discs to said multiplicity of complementary stamped discs of said female connector, thereby creating electrical continuity and allowing said connector system to turn around freely in a 360° rotation.

72. The invention as defined in claim 71 further comprising an annular recess facing forwardly and located adjacent to said rear end of said resilient cone shaped member of said male connector.

73. The invention as defined in claim 71 further comprising a lip portion facing rearwardly and located adjacent to said rear end of said resilient member of said female connector, where said annular recess of said resilient cone shaped member of said male connector receives the lip portion of said resilient member of said female connector.

74. The invention as defined in claim 71 wherein said resilient member of said female connector and said resilient cone shaped member of said male connector are made of elastomer material.

75. The invention as defined in claim 71 wherein said female connector and said male connector are manufactured in a molded in place process.

76. The invention as defined in claim 71 wherein said multiplicity of stamped discs of said male and female connectors are made of metal material.

* * * * *